US009928983B2

(12) United States Patent
Chaney et al.

(10) Patent No.: US 9,928,983 B2
(45) Date of Patent: Mar. 27, 2018

(54) VAPORIZER FOR ION SOURCE

(71) Applicant: Varian Semiconductor Equipment Associates, Inc., Gloucester, MA (US)

(72) Inventors: Craig R. Chaney, Gloucester, MA (US); David P. Sporleder, Billerica, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 21 days.

(21) Appl. No.: 15/198,742

(22) Filed: Jun. 30, 2016

(65) Prior Publication Data

US 2018/0005793 A1 Jan. 4, 2018

(51) Int. Cl.
*H01J 27/02* (2006.01)

(52) U.S. Cl.
CPC ..... *H01J 27/022* (2013.01)

(58) Field of Classification Search
USPC ..... 250/425, 423 R, 424
See application file for complete search history.

(56) References Cited

U.S. PATENT DOCUMENTS 5,747,818 A * 5/1998 Cecere ..... C23C 14/221 118/723 FI
6,107,634 A * 8/2000 Horsky ..... H01J 27/08 250/423 R
6,593,580 B2 7/2003 Miyabayashi
2002/0153493 A1 10/2002 Miyabayashi
2008/0057218 A1 3/2008 Gregg et al.
2008/0169427 A1 7/2008 Hatem et al.
2010/0186673 A1 7/2010 Tanaka et al.
2012/0064705 A1 3/2012 Horsky et al.
2014/0123892 A1 * 5/2014 Vladimirov ..... C30B 11/00 117/223

OTHER PUBLICATIONS

International Search Report and Written Opinion dated Aug. 24, 2017 in corresponding PCT application No. PCT/US2017/034005.

* cited by examiner

*Primary Examiner* — Kiet T Nguyen
(74) *Attorney, Agent, or Firm* — Nields, Lemack & Frame, LLC

(57) ABSTRACT

A vaporizer with several novel features to prevent vapor condensation and the clogging of the nozzle is disclosed. The vaporizer is designed such that there is an increase in temperature along the path that the vapor travels as it flows from the crucible to the arc chamber. The vaporizer uses a nested architecture, where the crucible is installed within an outer housing. Vapor leaving the crucible exits through an aperture and travels along the volume between the crucible and the outer housing to the nozzle, where it flows to the arc chamber. In certain embodiments, the aperture in the crucible is disposed at a location where liquid in the crucible cannot reach the aperture.

17 Claims, 7 Drawing Sheets

VAPORIZER FOR ION SOURCE

FIELD

Embodiments of the present disclosure relate to a vaporizer for use with an ion source, and more particularly, a vaporizer that may be deployed in various orientations.

BACKGROUND

Ion sources are employed to create the ions used to perform various semiconductor processes, such as ion implantation. In many embodiments, a dopant species, often in the form of a gas is introduced into the arc chamber of an ion source. The dopant species is then excited, such as by high energy electrons that have been accelerated across a potential or by radio frequency (RF) energy, to create ions. These ions are then extracted from the arc chamber in the form of an ion beam.

In certain embodiments, the dopant species may be in the form of a solid, which is vaporized prior to its use in the arc chamber of the ion source. For example, a solid material may be disposed in a crucible or tube, which is part of a vaporizer. The crucible is then heated, such as by an external heating coil. Vapor then exits the crucible through a nozzle, where it is guided toward the arc chamber of the ion source. In certain embodiments, the crucible may be disposed within the ion source itself.

One issue associated with vaporizers is condensation. As the crucible is heated, the solid material disposed within reaches a temperature sufficient to produce a needed vapor pressure of the solid material. However, as the vaporized gas exits the crucible, the gas may encounter regions which are at a lower temperature than that inside the crucible. If this lower temperature is less than the temperature of the solid material containing the dopant, the vapor may begin to condense. Condensation may reduce or even inhibit the flow of vapor to the ion source.

In addition, in certain embodiments, the nozzle of the vaporizer may be positioned lower than other portions of the vaporizer. In other words, the height of the nozzle may be less than other portions of the vaporizer. This may be problematic if the dopant containing species is in the liquid state. In certain applications, the solid material containing the dopant may have a melting temperature lower than the temperature necessary to produce a useable vapor pressure. In this case, the temperature of the crucible may be greater than the melting temperature. In such instances, the material may melt, and the vapor is generated from the liquid. This liquid may then flow toward the nozzle, which is lower in height than these other portions of the tube. This liquid may cause the vaporizer to clog. Also, it may be undesirable for the liquid to enter the arc chamber of the ion source.

In summary, current vaporizers suffer from two major drawbacks. The first is a temperature gradient across the vaporizer that causes some portions of the vaporizer to be cooler than other portions. This may cause some of the vapor in the vaporizer to condense and block the flow of the remaining vapor. The second issue is spatial orientation. As stated above, if the nozzle is lower in height than the rest of the crucible, liquid may flow toward the nozzle causing clogging.

Thus, it would be beneficial if there were a vaporizer that addressed these issues associated with condensation. It also would be advantageous if such a vaporizer could be deployed in a number of different orientations without condensed material flowing out of the vaporizer or clogging.

SUMMARY

A vaporizer with several novel features to prevent vapor condensation and the clogging of the nozzle is disclosed. The vaporizer is designed such that there is an increase in temperature along the path that the vapor travels as it flows from the crucible to the arc chamber. The vaporizer uses a nested architecture, where the crucible is installed within an outer housing. Vapor leaving the crucible exits through an aperture and travels along the volume between the crucible and the outer housing to the nozzle, where it flows to the arc chamber. In certain embodiments, the aperture in the crucible is disposed at a location where liquid in the crucible cannot reach the aperture.

According to one embodiment, a vaporizer is disclosed. The vaporizer comprises a crucible in which a dopant material may be disposed, having an aperture passing through a sidewall of the crucible; an outer housing surrounding the crucible; a vapor channel disposed between the outer housing and the crucible, wherein the aperture is in communication with the vapor channel; and a gas nozzle attached to one end of the outer housing in communication with the vapor channel. In some embodiments, the aperture is disposed in a location so that liquid in the crucible cannot reach the aperture. In certain embodiments, vapor travels in a path from the crucible through the aperture into the vapor channel and to the gas nozzle, and wherein a temperature is increasing as the vapor flows along the path from the aperture to the gas nozzle. In some embodiments, a spacer is disposed between the crucible and the outer housing, separating the crucible and the outer housing.

According to another embodiment, a vaporizer is disclosed. The vaporizer comprises a crucible in which a dopant material may be disposed; and an outer housing surrounding the crucible and having a gas nozzle; wherein the crucible is thermally isolated from the outer housing. In some embodiments, vapor formed in the crucible travels in a vapor channel located between an outer surface of the crucible and an inner surface of the outer housing. In some embodiments, the crucible comprises an aperture through a sidewall such that the vapor passes through the aperture into the vapor channel, wherein the aperture is disposed at a location having a height equal to or greater than the height of the dopant material.

According to a third embodiment, a vaporizer is disclosed. The vaporizer comprises a crucible in which a dopant material may be disposed, the crucible being cylindrical, sealed on two ends and having an aperture passing through a sidewall of the crucible; an outer housing surrounding the crucible, wherein a body of the outer housing is cylindrical; and a vapor channel disposed between the crucible and the outer housing, wherein the aperture is in communication with the vapor channel; wherein the outer housing comprises a first end and a second end opposite the first end, with a gas nozzle attached to the first end of the outer housing and in communication with the vapor channel. In certain embodiments, the vaporizer is oriented in an ion source such that the first end is lower than the second end, and wherein the aperture is disposed near the second end. In certain embodiments, the vaporizer is oriented in an ion source such that the first end is higher than the second end, and wherein the aperture is disposed near the first end.

BRIEF DESCRIPTION OF THE FIGURES

For a better understanding of the present disclosure, reference is made to the accompanying drawings, which are incorporated herein by reference and in which.

DETAILED DESCRIPTION

As described above, a vaporizer is used to heat a solid to produce a sufficient vapor pressure so that the vapor of a solid material containing a desired dopant species may be introduced into an arc chamber of an ion source. The vaporizer typically comprises a crucible to hold the solid material, a heating element to heat the crucible and a nozzle, through which the vapor exists the vaporizer.

The present vaporizer incorporates various novel features which reduce the possible of condensation and clogging in a way not previously possible.

Figure 1:
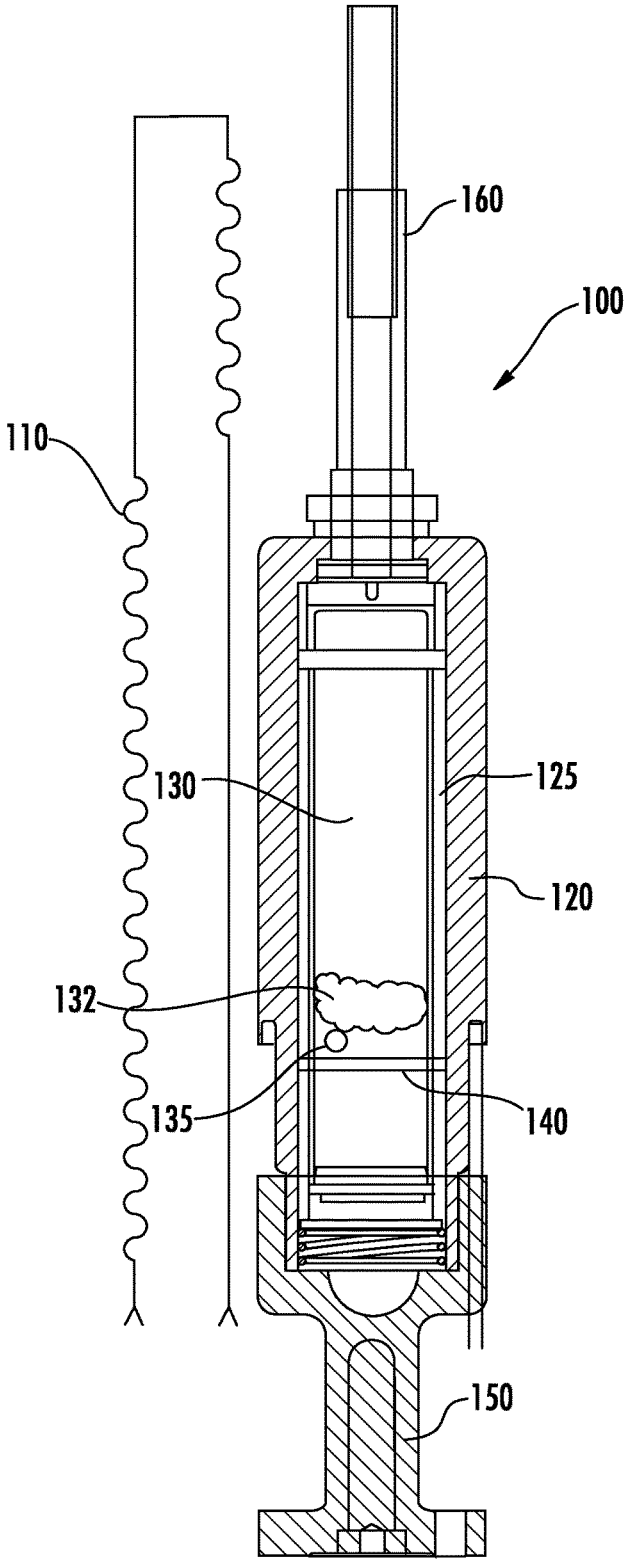
FIG. 1 is a vaporizer in accordance with one embodiment.

FIG. 1 shows a view of the vaporizer 100 according to one embodiment. The vaporizer 100 includes a heat source 110, which is used to supply heat to the crucible 130. The heat source 110 may be a resistive wire heater, where current is passed through the wire, causing the wire to heat. Other types of heat sources may also be used, such as, but not limited to heating lamps. While FIG. 1 shows the heat source 110 disposed adjacent to one side of the vaporizer 100, other embodiments are also possible. For example, in certain embodiments, the heat source 110 may wrap around the entirety of the vaporizer 100, providing heat on all sides. In other embodiments, the heat source 110 may be embedded within the outer housing 120 of the vaporizer 100. For example, the heat source 110 may be a resistive wire heater that is embedded directly in the outer housing 120.

The crucible 130 is used to hold the dopant material, which is typically in solid form. The crucible 130 may be constructed of any suitable material, such as graphite, a refractory metal or ceramic material. The crucible 130 may have a two piece construction, so that the two pieces of the crucible 130 may be separated to allow the solid dopant material to be placed therein. After the solid dopant material has been placed inside the crucible 130, the two pieces are then joined together. As an example, the crucible 130 may consist of a hollow tube with one closed end and one open end and a cap. The cap and hollow tube may each have threads that allow the two pieces to thread together, creating a crucible 130 where both ends are sealed.

The crucible 130 is disposed within an outer housing 120. The outer housing 120 may be constructed of a refractory metal, graphite, or ceramic material. In certain embodiments, the crucible 130 and the outer housing 120 are cylindrical in shape, and share a common major axis such that the spacing between the outer wall of the crucible 130 and the inner wall of the outer housing 120 is constant around the circumference of the crucible 130. The spacing between the outer wall of the crucible 130 and the inner wall of the outer housing 120 forms a vapor channel 125, through which vapor may flow.

In certain embodiments, spacers 140 are used to hold the crucible 130 in place within the outer housing 120, thus defining the vapor channel 125. In some embodiments, the spacers 140 are disposed in the vapor channel 125 and hold the crucible 130 such that vapor channel 125 between the crucible 130 and the outer housing 120 may have a uniform thickness. In other words, the spacers 140 cause the crucible 130 and the outer housing 120 to be concentric. However, in other embodiments, the spacers 140 may be configured such that the vapor channel 125 is not uniform thickness around the circumference. For example, the vapor channel 125 may be wider in the region where the vapor is intended to flow. The spacers 140 may be ring-shaped in certain embodiments. As will be described in more detail below, the spacers 140 may have notches, holes or openings to allow for the passage of vapor through the vapor channel 125. The spacers 140 may be constructed of any suitable material, such as graphite, or a refractory metal. Additionally, in certain embodiments, the spacers 140 may be used to better thermally isolate the crucible 130 from the outer housing 120 so that the outer housing 120 will be higher in temperature than the crucible 130. In this case, the spacers may be constructed of materials having low thermal conductivity and a high melting point. Suitable materials may include alumina or fused silica. In other words, in certain embodiments, the spacers 140 are constructed of a thermally insulating material.

In other embodiments, the crucible 130 may be disposed within the outer housing 120 without the use of spacers. For example, the crucible 130 may fit fairly tightly inside the outer housing 120. In this embodiment, a channel may be created in the inner wall of the outer housing 120. Alternatively, a channel may be created in the outer wall of the crucible 130. The channel may be created by removing material from the outer housing 120 or the crucible 130 after the component is created. Alternatively, the channel may be created by an insert in the mold used to create the outer housing 120 or the crucible 130.

In each of these embodiments, the channel formed in the outer housing 120 or the crucible 130 serves as the vapor channel 125.

In another embodiment, the crucible 130 snugly fits within the outer housing 120 at the two ends, such that the spacing between the sidewalls of the crucible 130 and the outer housing 120 is maintained by a friction fit. This spacing forms the vapor channel 125.

Figure 5:
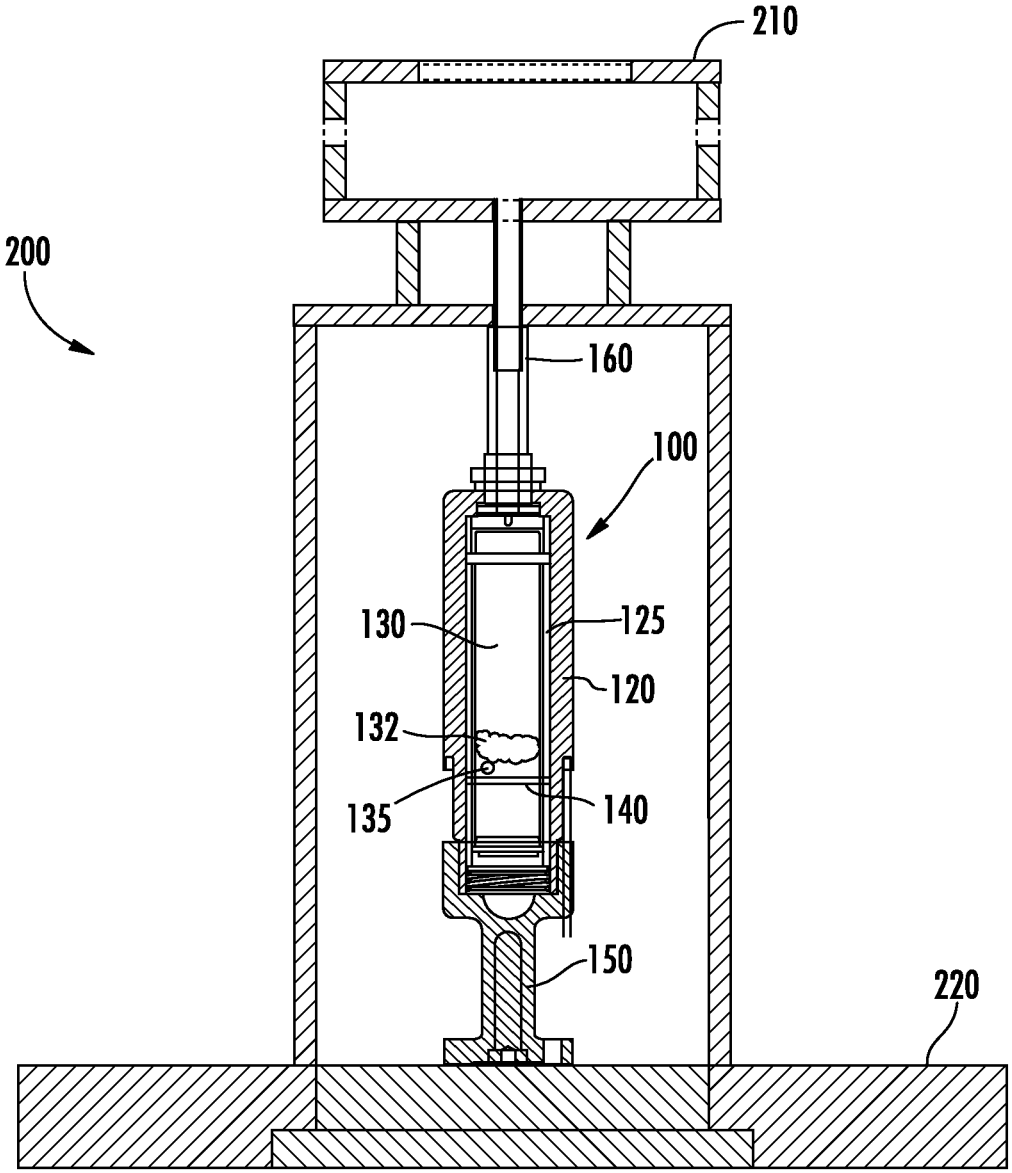
FIG. 5 shows the vaporizer of FIG. 1 as employed in an ion source.

As shown in FIG. 5, the outer housing 120 may be connected to a mounting base 150, which attaches the vaporizer 100 to the ion source 200. For instance, the arc chamber 210 may sit atop an ion source body 220 to which all other components of the ion source, including the vaporizer 100, are mounted. The mounting base 150 may be constructed using metal or another suitable material. The end of the outer housing 120 nearest the mounting base 150 may be sealed.

The end of the outer housing 120 that is opposite the mounting base 150 may be in communication with a gas nozzle 160. Vapor created in the crucible 130 exits the vaporizer 100 through the gas nozzle 160. In some embodiments, the gas nozzle 160 may be in communication with the arc chamber 210 of the ion source 200.

Figure 2:
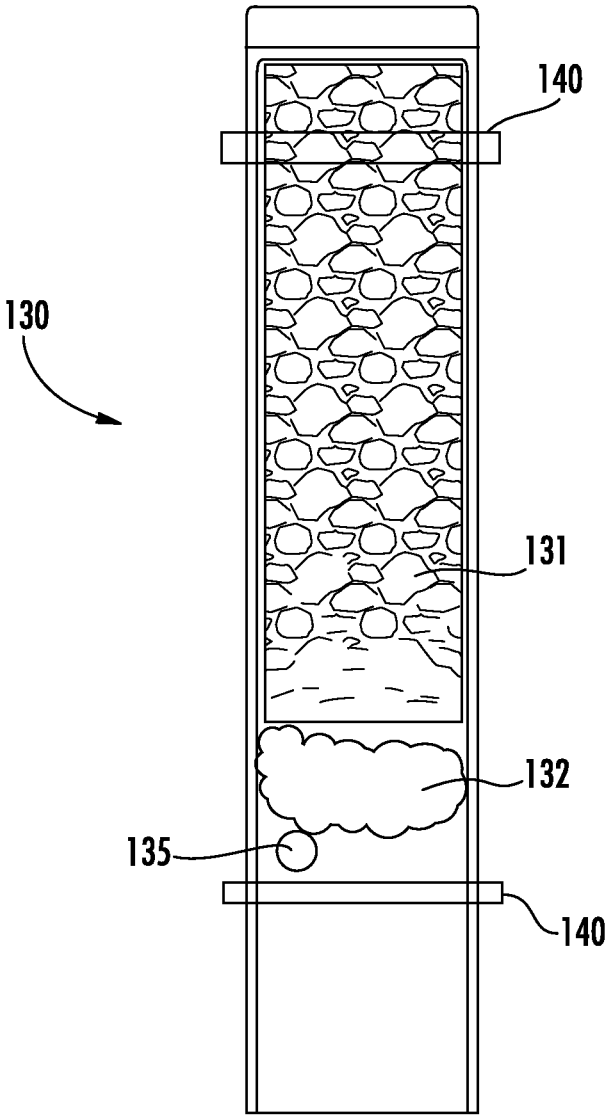
FIG. 2 is an enlarged view of the crucible of FIG. 1.

FIG. 2 shows a view of the crucible 130 of FIG. 1. As described earlier, spacers 140 may be disposed around the crucible 130 to separate the crucible 130 from the outer housing 120. While FIG. 1 and FIG. 2 show two spacers 140, any number of spacers 140 may be used and the disclosure does not limit the number of spacers 140 that can be employed. Alternatively, as described above, in certain embodiments, spacers 140 are not used. An aperture 135 is disposed in the side of the crucible 130. In certain embodiments, the aperture 135 is disposed on the cylindrical sidewall of the crucible 130. However, the aperture 135 may be disposed on an end of the crucible 130 in other embodiments. The aperture 135 passes through the wall of the crucible 130 and provides a pathway for vapor from the interior of the crucible 130 to the vapor channel 125. Thus, in certain embodiments, the crucible 130 may be sealed at both ends, with the only opening being the aperture 135 disposed on the cylindrical sidewall of the crucible 130.

In certain embodiments, such as that shown in FIG. 1, spacers 140 are used to create the vapor channel 125, which is in communication with the aperture 135 and the gas nozzle 160. In other embodiments, the vapor channel 125 is created by including a channel or notch along the inner wall of the outer housing 120 or the outer wall of the crucible 130. In these embodiments, the channel or notch extends from the aperture 135 to the gas nozzle 160.

The solid dopant material 131 is disposed within the crucible 130, and is separated from the aperture 135 through the use of a filter 132. The filter 132 may be quartz wool or another suitable material. The filter 132 serves as a filter which allows the passage of gasses, but prevents the passage of the solid dopant material 131.

Having enumerated the various components in the vaporizer 100, its operation will now be described with reference to FIGS. 1-2. The heat source 110 is used to apply heat to the outer housing 120, and in some instances, to the gas nozzle 160. As the outer housing 120 is heated, heat is also radiated to the crucible 130. Since the crucible 130 is separated from the outer housing 120 through the use of spacers 140, it heats at a slower rate and may reach a lower final temperature. As the solid dopant material 131 heats, vapor is formed. This vapor passes through the filter 132 and exits the crucible 130 through the aperture 135. In certain embodiments, the aperture 135 is disposed in the sidewall of the crucible 130 so as be at a height that is greater than or equal to the solid dopant material when the vaporizer 100 is installed in the ion source 200. In this way, dopant material in the condensed phase will not flow out of the aperture 135.

The vapor then moves along the vapor channel 125 between the outer housing 120 and the crucible 130. Since this vapor channel 125 is adjacent to the outer housing 120, it is at a higher temperature than the crucible 130. Thus, the possibility of condensation is greatly reduced. The vapor then exits the vaporizer 100 through the gas nozzle 160. Again, since the gas nozzle 160 is closer in proximity to the arc chamber 210 of the ion source 200 than other parts of the vaporizer 100, the gas nozzle 160 will be higher in temperature, further reducing the possibility of condensation. Thus, the temperature of the path travelled by the vapor may be increasing as the vapor moves toward the arc chamber 210 of the ion source 200.

Note that the vapor moves along the vapor channel 125 to reach the gas nozzle 160. To do so, in certain embodiments, the vapor passes through the spacers 140 that are disposed in the vapor channel 125. To allow for this passage of vapor, the spacers 140 may be designed with one or more notches, holes or openings therein.

Figure 4A:
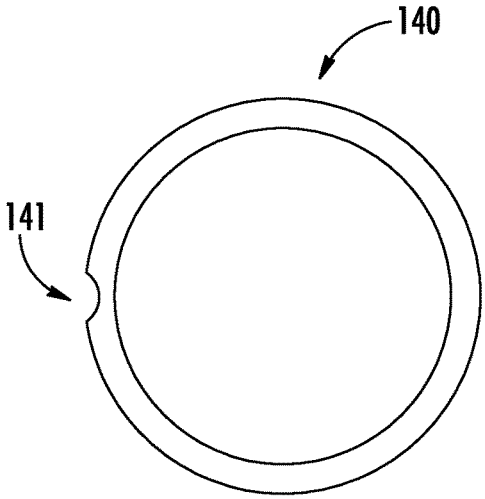
FIGS. 4A-4C show different configurations of the spacers used in FIG. 1.

FIG. 4A shows a spacer 140 according to one embodiment. This spacer 140 has a single opening, in the form of a notch 141, disposed along its outer circumference. In this embodiment, all of the vapor passes through this notch 141 to reach the gas nozzle 160. In certain embodiments, the heat source 110 may be disposed along one side of the outer housing 120, thus making this portion of the outer housing 120 warmer than other portions. In these embodiments, the notch 141 may be disposed near the warmer portion of the outer housing 120. While FIG. 4A shows a notch 141 along the outer circumference, other embodiments are also possible. For example, the spacer 140 may have an opening or hole therethrough. Further, the notch 141 may be disposed along the inner circumference of the spacer 140. Thus, the type or position of the opening in the spacer 140 is not limited by this disclosure.

Figure 4B:
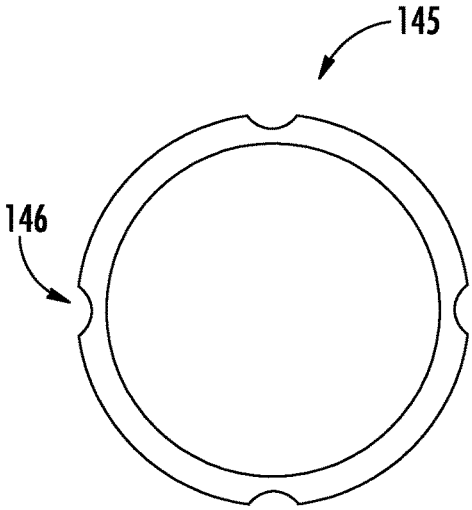

In other embodiments, the heat source 110 may be wrapped around the outer housing 120. In these embodiments, the entirety of the outer housing 120 may be at or near the same temperature. FIG. 4B shows a spacer 145 which may be used with this configuration. The spacer 145 has a plurality of openings, in the form of notches 146, disposed around its outer circumference, allowing vapor to pass through. Again, openings or holes may be used instead of notches 146. Further, the notches 146 may be disposed along the inner circumference of the spacer 145.

Figure 4C:
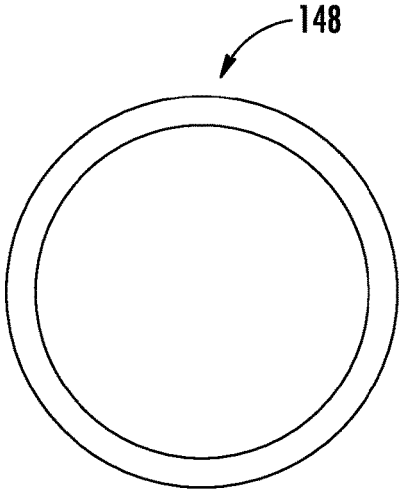

FIG. 4C shows a spacer 148, which has no notches, holes or openings. This spacer 148 does not permit the passage of vapor. Its use is described below.

Figure 3A:
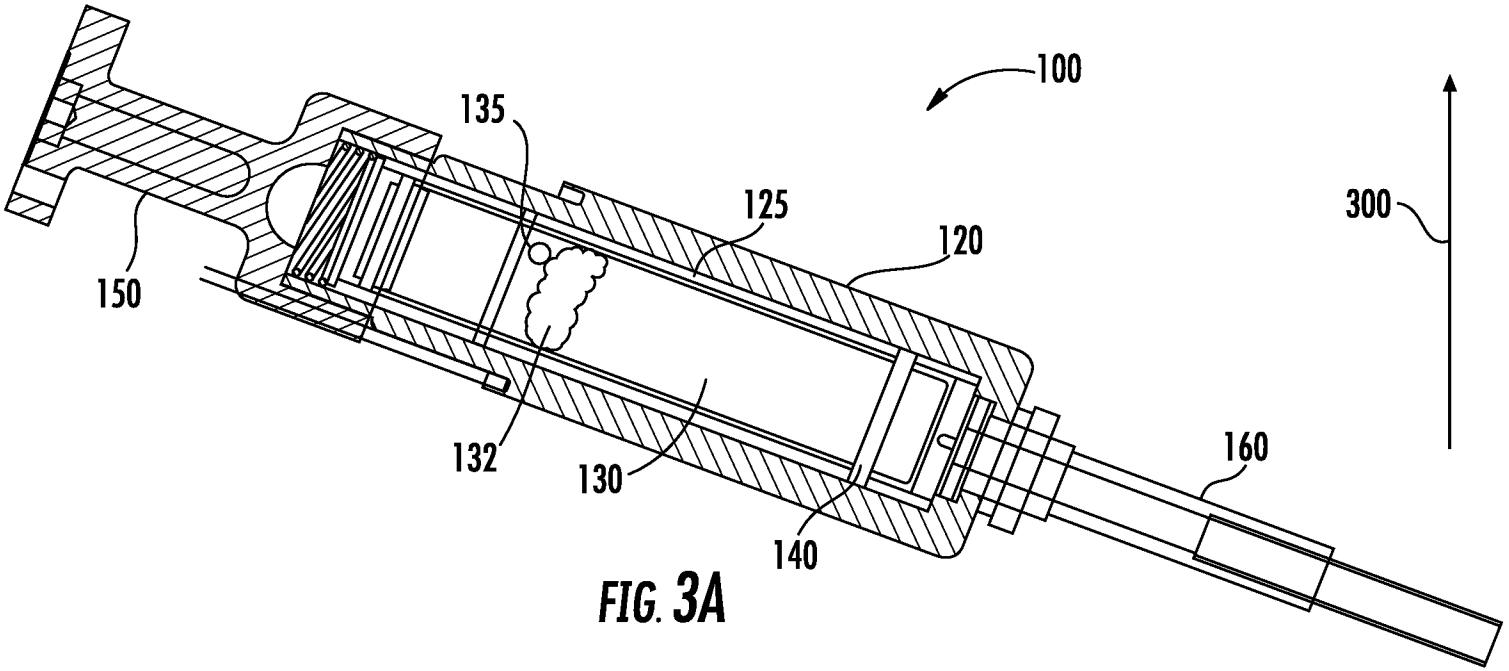
FIGS. 3A-3C show the vaporizer of FIG. 1 deployed in different orientations.
Figure 3B:
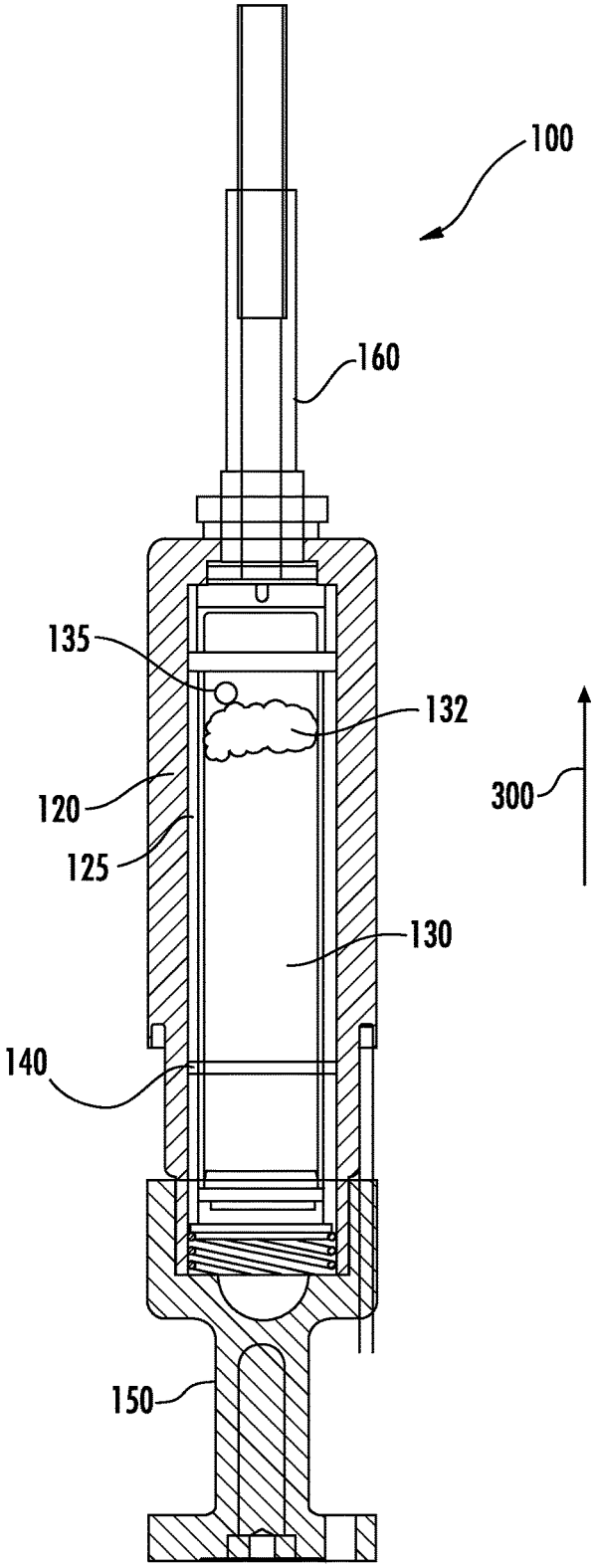
Figure 3C:
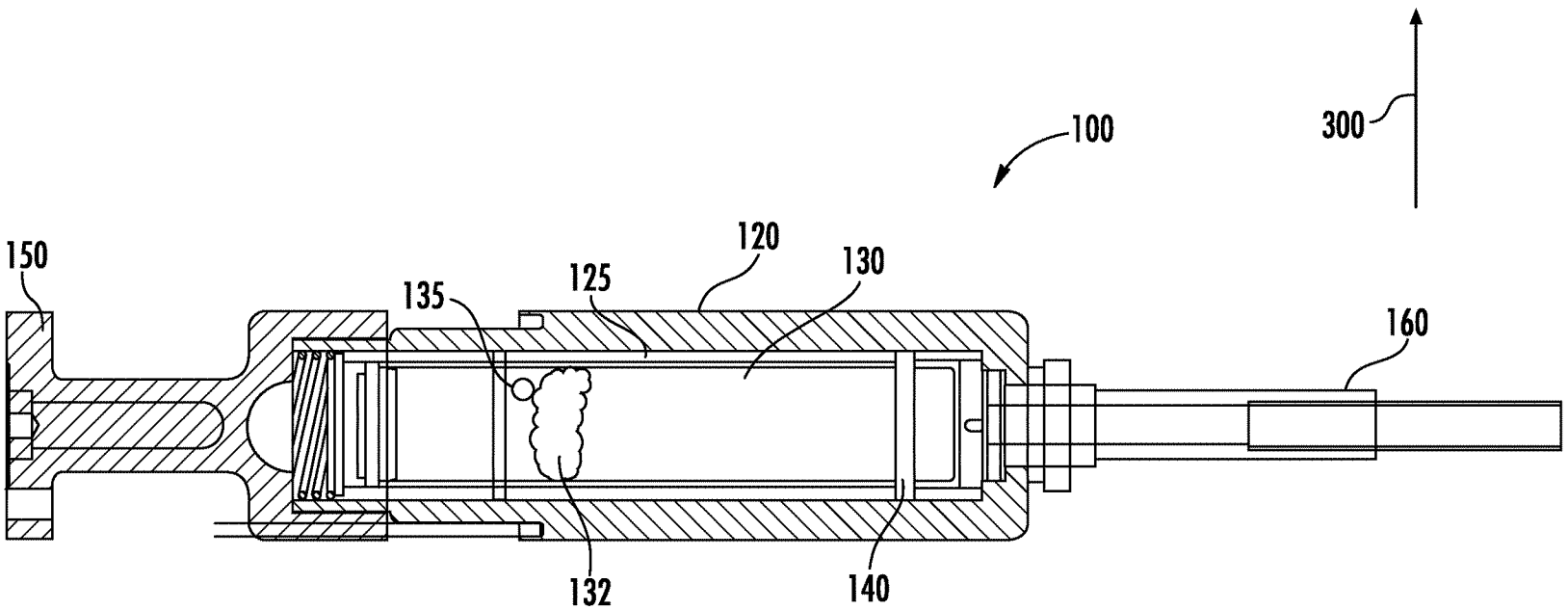

The vaporizer 100 described herein may be used in a plurality of orientations. FIG. 3A shows the vaporizer 100 in an orientation where the gas nozzle is tilted at a downward angle. In FIGS. 3A-3C, line 300 points in the upward direction. Of course, other angles may also be employed, and FIG. 3A is meant to illustrate the operation of the vaporizer 100 when the gas nozzle 160 is at a height lower than the crucible 130.

In this embodiment, the aperture 135 is disposed on the sidewall, closer to the end where the mounting base 150 is disposed. This location is selected as it is higher than the level of the solid dopant material that is disposed within the crucible 130. The location of the aperture 135 has two aspects to it. The first aspect is the location of the aperture 135 along the sidewall in the axial direction. The second aspect is the location of the aperture 135 along the radial direction. In FIG. 3A, the aperture 135 is shown near the mounting base 150 in the axial direction and disposed near the top of the crucible 130 in the radial direction. This location of the aperture 135 provides a natural flow path for the vapor in the crucible 130, as the aperture 135 will not be obstructed by condensed dopant material. As the dopant material vaporizes, vapor passes through the filter 132 to the aperture 135. Once the vapor exits the aperture 135, it moves along vapor channel 125 and through the openings in spacers 140 toward the gas nozzle 160. Since the arc chamber 210 is maintained at very low pressure, the vapor is drawn toward the gas nozzle 160.

FIG. 3B shows an embodiment where the vaporizer 100 is installed with the gas nozzle 160 pointing vertically upward. Again, this figure is merely illustrative and the description is applicable to any orientation where the gas nozzle 160 is tilted upward.

In this embodiment, the aperture 135 is disposed on the sidewall of the crucible 130 closer to the gas nozzle 160 in the axial direction. In this way, the vapor flows upward through the filter 132 and exits through the aperture 135. The vapor then flows toward the lower pressure arc chamber 210. In this embodiment, the spacers 140 used may be those shown in FIG. 4C. These spacers 148 inhibit the flow of vapor through the vapor channel 125 and force the vapor upward toward the gas nozzle 160.

FIG. 3C shows a third orientation where the vaporizer 100 is horizontal. In this orientation, the location of the aperture 135 in the axial direction can vary, as all locations are at the same height. The aperture 135 may be at the highest point in the radial direction. While the location of the aperture 135 may vary, in certain embodiments, the aperture 135 is disposed at one of the two ends of the crucible 130. These two positions allow the maximum amount of solid dopant material 131 to be disposed in the crucible 130 and allow convenient placement of the filter 132. However, the selection of one of these two locations may be implementation dependent.

If the aperture 135 is disposed near the mounting base 150, as shown in FIG. 3C, the openings in the spacers 140 may be disposed along the top part of the vapor channel 125. This further reduces the chances of clogging in case of condensation, as the condensate will flow toward the lower part of the vapor channel 125.

The embodiments described above in the present application may have many advantages. In each of these embodiments, several common attributes can be found.

First, in all of these embodiments, the aperture 135 in the crucible 130 is disposed in a location that is not easily reached by liquid. In other words, even if liquid were to form within the crucible 130, that liquid cannot reach the aperture 135 and flow into the vapor channel 125 where it may clog that passageway. In this way, the risk of clogging is reduced considerably.

Second, in each of these embodiments, the path for the vapor is one in which the temperature is increasing as the vapor flows along the path. As described above, the crucible 130 is thermally isolated from the outer housing 120, and therefore is cooler than the outer housing. As vapor exits the crucible 130, it enters a vapor channel 125, which is adjacent to the outer housing 120, and therefore is warmer than the crucible 130. Additionally, as the vapor moves toward the gas nozzle 160, it is further heated as the gas nozzle 160 is also heated by the arc chamber 210. Thus, the risk of condensation along the path from the crucible 130 to the arc chamber 210 is greatly reduced.

Third, the crucible 130 may be installed in the outer housing 120 in different configurations. For example, the crucible 130 may be installed such that the aperture 135 is closer to the gas nozzle 160 or closer to the mounting base 150. The ability to reconfigure the aperture 135 allows the vaporizer 100 to be disposed in a plurality of orientations, including vertical, horizontal, upwardly tilting and downward tilting. Further, the risk of clogging and condensation is minimized in each of these orientations.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A vaporizer, comprising:

a crucible in which a dopant material may be disposed, having an aperture passing through a sidewall of the crucible;

an outer housing surrounding the crucible;

a vapor channel disposed between the outer housing and the crucible, wherein the aperture is in communication with the vapor channel; and a gas nozzle attached to one end of the outer housing in communication with the vapor channel.

2. The vaporizer of claim 1, wherein the crucible and the outer housing are concentric cylinders.

3. The vaporizer of claim 1, comprising a heat source disposed outside of the outer housing.

4. The vaporizer of claim 1, comprising a heat source embedded in the outer housing.

5. The vaporizer of claim 1, wherein a temperature in the vapor channel is greater than a temperature in the crucible.

6. The vaporizer of claim 1, wherein the aperture is disposed in a location so that liquid in the crucible cannot reach the aperture.

7. The vaporizer of claim 1, wherein vapor travels in a path from the crucible through the aperture into the vapor channel and to the gas nozzle, and wherein a temperature is increasing as the vapor flows along the path from the aperture to the gas nozzle.

8. The vaporizer of claim 1, comprising a spacer disposed between the crucible and the outer housing, separating the crucible and the outer housing.

9. The vaporizer of claim 8, wherein the spacer is constructed of a thermally insulating material.

10. The vaporizer of the claim 8, wherein the spacer is disposed between the gas nozzle and the aperture, and the spacer comprises an opening to allow vapor to pass.

11. The vaporizer of claim 1, wherein the crucible is thermally isolated from the outer housing.

12. A vaporizer, comprising:

a crucible in which a dopant material may be disposed, the crucible being cylindrical, sealed on two ends and having an aperture passing through a sidewall of the crucible;

an outer housing surrounding the crucible, wherein a body of the outer housing is cylindrical; and a vapor channel disposed between the crucible and the outer housing, wherein the aperture is in communication with the vapor channel;

wherein the outer housing comprises a first end and a second end opposite the first end, with a gas nozzle attached to the first end of the outer housing and in communication with the vapor channel.

13. The vaporizer of claim 12, wherein the vaporizer is oriented in an ion source such that the first end is lower than the second end, and wherein the aperture is disposed near the second end.

14. The vaporizer of claim 12, wherein the vaporizer is oriented in an ion source such that the first end is higher than the second end, and wherein the aperture is disposed near the first end.

15. The vaporizer of claim 12, comprising a spacer disposed between the crucible and the outer housing, separating the crucible and the outer housing.

16. The vaporizer of claim 15, wherein the spacer is constructed of a thermally insulating material.

17. The vaporizer of the claim 15, wherein the spacer is disposed between the gas nozzle and the aperture, and the spacer comprises an opening to allow vapor to pass.

* * * * *